US006148961A

United States Patent [19]

Kadoche

[11] Patent Number: 6,148,961

[45] Date of Patent: Nov. 21, 2000

[54] LIFT DRIVING DEVICE

[76] Inventor: Emile Kadoche, 32 rue de la Butte, 78640 Neauphle le Chateau, France

[21] Appl. No.: 09/214,283

[22] PCT Filed: Jul. 1, 1997

[86] PCT No.: PCT/FR97/01172

§ 371 Date: Dec. 31, 1998

§ 102(e) Date: Dec. 31, 1998

[87] PCT Pub. No.: WO98/00358

PCT Pub. Date: Jan. 8, 1998

[30] Foreign Application Priority Data

Jul. 2, 1996 [FR] France ..... 96 08206

[51] Int. Cl.[7] ..... B66B 11/04

[52] U.S. Cl. ..... 187/253; 187/272; 187/401

[58] Field of Search ..... 187/253, 252, 187/272, 401, 404, 409; 254/271, 264

[56] References Cited

U.S. PATENT DOCUMENTS

| | | | |
|---|---|---|---|
| 4,333,549 | 6/1982 | Davis | 187/377 |
| 4,674,938 | 6/1987 | Van Stokes et al. | 187/253 |
| 4,830,146 | 5/1989 | Nakamura et al. | 187/253 |
| 5,636,712 | 6/1997 | Muller et al. | 187/404 |
| 5,653,311 | 8/1997 | Heikkinen et al. | 187/253 |
| 5,750,945 | 5/1998 | Fuller et al. | 187/411 |
| 5,833,031 | 11/1998 | Liebetrau et al. | 187/404 |

FOREIGN PATENT DOCUMENTS

| | | | |
|---|---|---|---|
| 0687644 | 12/1995 | European Pat. Off. . | |
| 4034564 | 4/1992 | Germany | 187/253 |
| 1438727 | 6/1976 | United Kingdom . | |
| 8705282 | 9/1987 | WIPO . | |

*Primary Examiner*—Dean J. Kramer
*Assistant Examiner*—Paul T. Chin
*Attorney, Agent, or Firm*—Ostrolenk, Faber, Gerb & Soffen, LLP

[57] ABSTRACT

The invention relates to a drive device for an elevator of the type comprising a cage secured to a frame (16, 18) co-operating with vertical guide means (12, 14). The device comprises: a moving horizontal cross-member (20) that is independent of the frame and that co-operates with the vertical guide means (12, 14); an actuator comprising a cylinder (24) and a vertically movable rod (26), the actuator cylinder being secured to the frame (16, 18) and the end (26*a*) of the actuator rod being secured to the moving cross-member; first and second sets of pulley wheels (32, 34) mounted to rotate freely about first and second horizontal axes (56, 60) respectively secured to the moving cross-member and to the frame; and a cable (36) passing over said sets of pulley wheels to constitute a pulley block system, a first end (40) of said cable being secured to the top end of the elevator shaft and the other end (38) thereof being secured to one of said two elements.

6 Claims, 2 Drawing Sheets

LIFT DRIVING DEVICE

BACKGROUND OF THE INVENTION

The present invention relates to a drive device for an elevator or a similar installation.

More precisely, the invention relates to means for controlling the up and down movement of an elevator cage or the like in the elevator shaft in which it is installed.

In the present patent application, the term "elevator cage or the like" covers not only conventional elevators for the able bodied, but also hoists and lifts for goods or for the handicapped.

It is well known that there are two major techniques in existence for implementing the drive device that controls the up and down movements of an elevator cage, which devices are either electrical or hydraulic. The present invention relates solely to the field of hydraulically controlled elevators. Naturally, the term "hydraulic" control covers means that are powered by a liquid that is not necessarily water.

In drive systems for elevators of the hydraulic type, it is conventional to have an actuator whose stroke serves to control the displacements of the elevator. The actuator cylinder is fixed in the elevator shaft and the end of the actuator rod is secured to the frame which is itself secured to the elevator cage.

It will be understood that controlling the displacement of an elevator cage in this way requires an actuator to be implemented whose stroke is very large since it is naturally equal to the displacement amplitude of the elevator cage. This makes it necessary in particular to use actuators having telescopic rods which become very difficult to make once the stroke of the elevator is large.

Nevertheless, it should be emphasized that hydraulic devices for moving an elevator cage present numerous advantages over electrically controlled devices. In particular, the cost of hydraulic drive devices for large loads is small compared with the cost of electric motor devices, and in addition such control devices are much quieter than electric motor devices. This advantage of quietness becomes particularly important when installing elevators in buildings.

SUMMARY OF THE INVENTION

An object of the present invention is thus to provide a hydraulic type drive device for an elevator that makes it possible to develop a large stroke for the elevator while nevertheless being simpler in structure than conventional hydraulic means for controlling displacement.

To achieve this object, the invention provides a drive device for an elevator of the type comprising a cage secured to a frame co-operating with vertical guide means, the drive device being characterized in that it comprises:

- a moving horizontal cross-member independent from the frame and co-operating with the vertical guide means;
- an actuator comprising a cylinder and a rod that is vertically movable, the actuator cylinder being secured to one of the elements constituted by the frame and the cross-member, the end of the actuator rod being secured to the other of said two elements;
- first and second sets of pulley wheels mounted to rotate freely about respective horizontal axes secured respectively to the moving cross-member and to the frame;
- a cable passing over said sets of pulley wheels to constitute a pulley block system, a first end of said cable being secured to the top end of the elevator shaft and the other end of the cable being secured to one of said two elements; and
- means for controlling displacement of the actuator rod relative to the actuator cylinder.

It will be understood that the stroke of the actuator serves merely to move apart the frame proper and the horizontal cross-member which is free to move vertically relative to the frame. The two sets of pulley wheels mounted respectively on the frame and on the cross-member constitute a pulley block system. By moving the two sets of pulley wheels apart, the elevator is caused to move up through a distance which is equal to the displacement of the actuator rod multiplied by the number of cable strands passing over the pulleys, given that the two sets of pulley wheels constitute a pulley block system. For example, if each set of pulley wheels has four pulley wheels, then the effective stroke of the elevator is eight times the effective stroke of the actuator.

In a preferred embodiment, the horizontal cross-member is disposed beneath the frame.

It will be understood that this disposition is highly advantageous since there is necessarily room available at the bottom of the elevator shaft when the elevator cage is in its lowest position.

Also preferably, the actuator cylinder is secured to the frame and the end of the actuator rod is secured to the horizontal cross-member.

Other characteristics and advantages of the invention appear better on reading the following description of various embodiments of the invention given as non-limiting examples.

BRIEF DESCRIPTION OF THE DRAWINGS

The description refers to the accompanying figures, in which.

DETAILED DESCRIPTION OF THE PREFERRED EMBODIMENT

Figure 1:
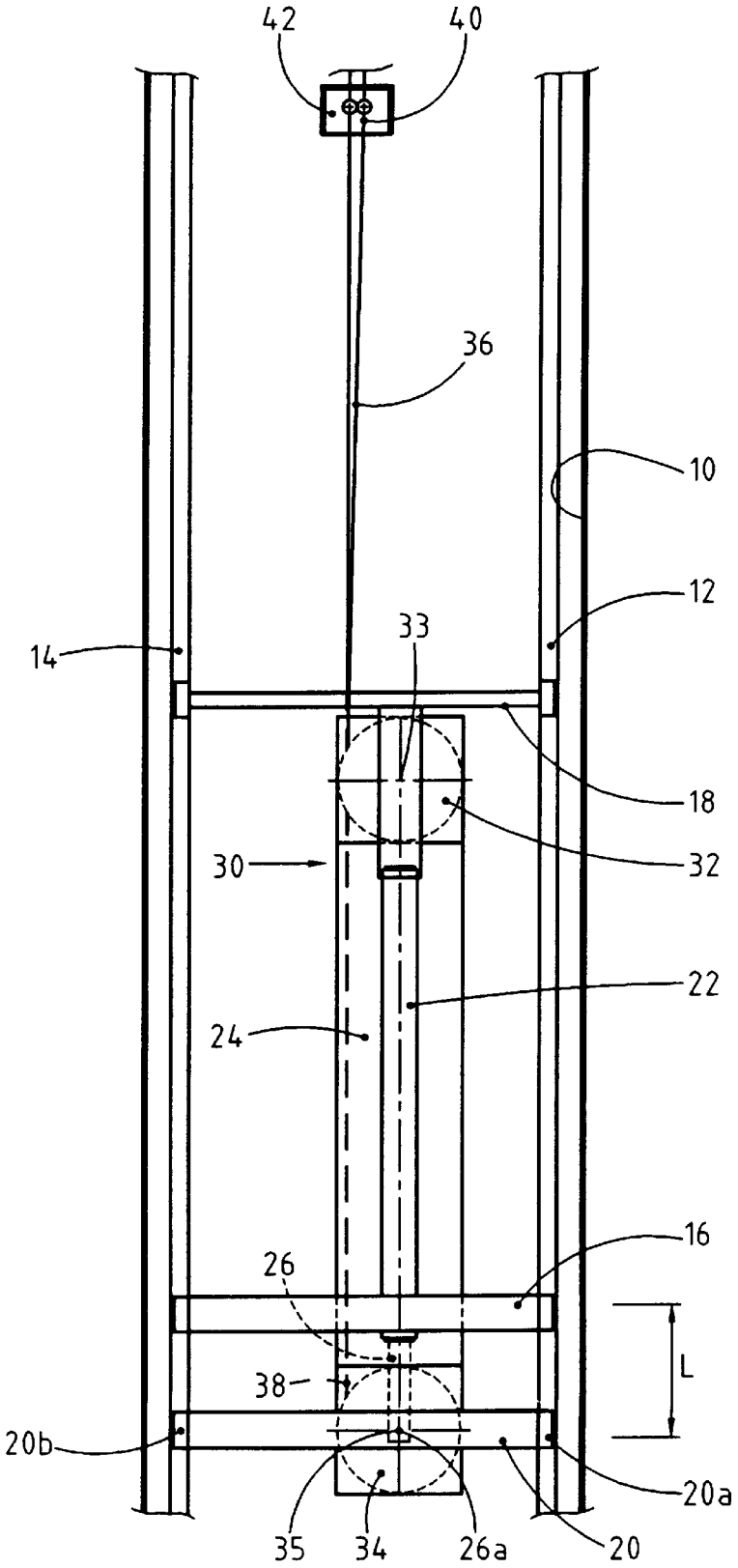
FIG. 1 is a diagrammatic view explaining the principle on which the elevator drive device operates.

With reference initially to FIG. 1, the principle of the drive device of the invention is described. In this simplified figure, there can be seen the elevator shaft 10 with two vertical guide bars 12 and 14 mounted on the walls thereof. This figure also shows the bottom and top cross-members 16 and 18 forming parts of the elevator frame secured to the cage (the cage not being shown in the figure). In other words, the cross-members 16 and 18 co-operate with the vertical guide bars 12 and 14 and are secured to each other and are secured to the cage. The drive device also has an additional cross-member 20 whose ends 20*a* and 20*b* co-operate with the guide bars 12 and 14, but the cross-member 20 is free to move relative to the frame 16, 18. Preferably, the cross-member 20 is disposed beneath the frame. The drive device also comprises a hydraulic actuator 22 whose cylinder 24 is preferably secured to the cross-members 16 and 18 of the frame and whose rod 26 has an end 26*a* secured to the independent cross-member 20. The actuator 22 is mounted vertically and its rod naturally also moves in a vertical direction.

It will be understood that by controlling the actuator 22, it is possible to extend the actuator rod 26 and thus cause the independent cross-member 20 to move away from the frame, and more particularly away from the bottom cross-member 16 thereof, and to do so through a distance corresponding to the stroke of the actuator rod.

The drive device also comprises a pulley block system 30 constituted by a first set of horizontal axis pulley wheels 32 and a second set of horizontal axis pulley wheels 34. The axis 33 of the pulley wheels 32 is secured to the top cross-member 18 of the elevator frame while the axis 35 of the pulley wheels 34 is secured to the independent cross-member 20. The pulley wheels are free to rotate about their axes. A cable 36 of the type commonly used in elevators passes over the pulley wheels 32 and 34 to constitute the pulley block system. The first end 38 of the cable is preferably secured to the independent cross-member 20 while the second end 40 of the cable is fixed relative to the elevator shaft, with its fixing point 42 being disposed higher than the highest level that the elevator is to reach.

It will be understood that under drive from the actuator 22 which moves the independent cross-member 20 away from the frame and thus away from the top cross-member 18, the distance between the two pulley blocks can be increased. This increase in distance naturally affects the various strands of the cable 36 passing over the pulley wheels 32 and 34. Because the end 40 of the cable is secured to a fixed point and because the other end 38 of the cable is secured to the independent cross-member 20, this moving apart causes the frame 16, 18 to rise and thus causes the elevator cage to rise through a distance which is equal to the stroke of the rod 26 of the actuator multiplied by the number of cable strands 36 passing over the pulley wheels 32 and 34. For example, if each set of pulley wheels has four independent pulley wheels, then the stroke of the elevator will be equal to eight times the stroke of the actuator.

It will thus be understood that even when using an actuator of relatively limited stroke, it is possible by providing a sufficient number of cable strands and thus of pulley wheels, to achieve a total stroke for the elevator cage that is compatible with the various uses of such an elevator.

It will also be understood that the displacement speed of the elevator cage is equal to the displacement speed of the actuator rod likewise multiplied by the number of strands. In the example under consideration, this speed is thus multiplied by eight.

When the elevator cage, i.e. the frame 16, 18 occupies its lowest position, the actuator rod 26 is fully retracted.

Figure 2:
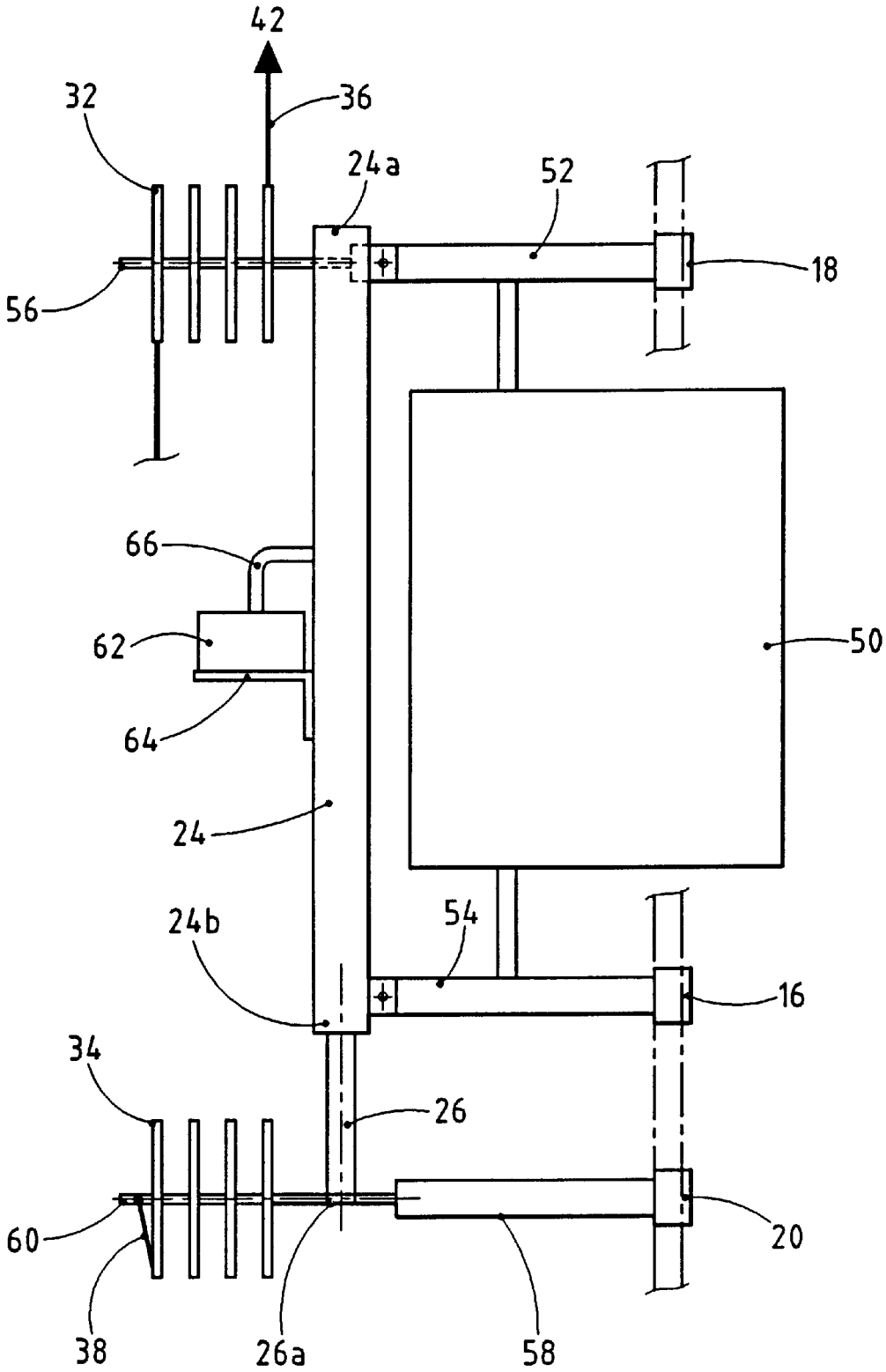
FIG. 2 is a more detailed view of the drive device mounted on the elevator cage shown in side view.

With reference now to FIG. 2, there follows a more detailed description of a preferred embodiment of the elevator drive device whose principle is explained above with reference to FIG. 1.

FIG. 2 shows the cage 50 of the elevator secured to its frame. The frame is constituted by the cross-members 16 and 18 and by top and bottom mechanical structures 52 and 54 which are naturally also secured to the cage 50. The top portion 24*a* of the actuator cylinder 24 is fixed to the mechanical structure 52 while its bottom portion 24*b* is fixed to the mechanical structure 54, with the actuator cylinder naturally extending vertically. The top structure 52 also has fixed thereon a horizontal shaft 56 on which the top pulley wheels 32 are mounted to rotate freely. In the particular example described, there are four such pulley wheels. In the same manner, the independent cross-member 20 has a mechanical structure 58 mounted thereon with the end 26*a* of the actuator rod 26 fixed thereto. The link between the end of the actuator rod and the structure 58 is preferably hinged. The part 58 also has mounted thereon a horizontal shaft 60 in register with the top shaft 56. This shaft 60 carries the pulley wheels 34 of the bottom set of pulley wheels, and they are free to rotate thereon. Naturally there are likewise four pulley wheels. In the figure, the various strands of the cable 36 passing over the pulley wheels 32 and 34 are not shown. The figure shows only the end 38 and the running portion 36.

In FIG. 2, there is also shown diagrammatically, fixed or example to the actuator cylinder 24, the hydraulic motor 62 which is used for controlling displacement of the actuator rod 26 and relative to the cylinder 24. There is also shown a mechanical structure 64 for supporting the motor 62 and a duct 66 connecting the motor 62 to the feed inlet of the actuator cylinder 24.

An additional advantage of the present invention lies in that the quantity of driving liquid required is small because of the short stroke of the actuator rod.

What is claimed is:

1. A drive device for an elevator of the type comprising a cage secured to a frame co-operating with vertical guide means, the drive device being characterized in that it comprises:

a moving horizontal cross-member (20) independent from the frame and co-operating with the vertical guide means (12);

an actuator comprising a cylinder (24) and a rod (26) that is vertically movable, the actuator cylinder being secured to one of the elements constituted by the frame (16, 18) and the cross-member, the end (26*a*) of the actuator rod being secured to the other of said two elements;

first and second sets of pulley wheels (32, 34) mounted to rotate freely about respective horizontal axes (56, 60) secured respectively to the moving cross-member and to the frame;

a cable (36) passing over said sets of pulley wheels to constitute a pulley block system, a first end (40) of said cable being secured to the top end of an elevator shaft and the other end (38) of the cable being secured to one of said two elements; and means (62) for controlling displacement of the actuator rod relative to the actuator cylinder.

2. A device according to claim 1, characterized in that said moving cross-member (20) is disposed beneath said frame (16, 18).

3. A device according to claim 1, characterized in that the actuator cylinder (24) is secured to the frame (16, 18), and in that the end (26*a*) of the actuator rod (26) is secured to the independent cross-member (20).

4. A device according to claim 3, characterized in that said frame has a top cross-member and a bottom cross-member, and in that the cylinder of said actuator is secured to both of its cross-members.

5. A device according to claim 4, characterized in that the set of pulley wheels mounted on the frame is mounted on the top cross-member of said frame.

6. A device according to claim 1, characterized in that the rod (26) of said actuator is entirely retracted into the cylinder (24) of said actuator when the elevator cage is in its lowest position.

* * * * *